United States Patent [19]

Feldstein

[11] 4,150,171

[45] Apr. 17, 1979

[54] ELECTROLESS PLATING

[75] Inventor: Nathan Feldstein, Princeton, N.J.

[73] Assignee: Surface Technology, Inc., Princeton, N.J.

[21] Appl. No.: 893,246

[22] Filed: Apr. 5, 1978

Related U.S. Application Data

[60] Division of Ser. No. 672,046, Mar. 30, 1976, which is a division of Ser. No. 521,901, Nov. 8, 1974, Pat. No. 3,993,491, which is a continuation-in-part of Ser. No. 422,774, Dec. 7, 1973, abandoned.

[51] Int. Cl.[2] ..... C23C 3/02

[52] U.S. Cl. ..... 427/54; 106/1.11; 427/98; 427/304; 427/305; 427/306; 427/261

[58] Field of Search ..... 427/54, 92, 98, 304, 427/305, 306

[56] References Cited

U.S. PATENT DOCUMENTS

| | | | |
|---|---|---|---|
| 3,524,754 | 8/1970 | Blytas et al. | 427/304 |
| 3,562,005 | 2/1971 | De Angelo et al. | 427/98 |
| 3,672,925 | 6/1972 | Feldstein | 427/98 |
| 3,772,078 | 11/1973 | Polichette et al. | 427/304 |
| 3,793,072 | 2/1974 | Lando | 427/98 |
| 3,962,494 | 6/1976 | Nuzzi | 427/306 |
| 3,993,491 | 11/1976 | Feldstein | 427/304 |
| 4,084,023 | 4/1978 | Dafter | 427/98 |

*Primary Examiner*—Ralph S. Kendall
*Attorney, Agent, or Firm*—Joel F. Spivak

[57] ABSTRACT

Dielectric or non-conductive substrates are electrolessly plated by contacting the surface of the substrate with aqueous solutions containing stannous and copper ions, the solutions being alternatively combined with a single solution, followed by contacting the surface of the substrate with a reducing agent capable of reducing the valence state of the copper ions. Systems of solutions useful in the practice of the aforesaid process are also disclosed.

8 Claims, No Drawings

ELECTROLESS PLATING

REFERENCE TO PRIOR APPLICATION

This is a division of application Ser. No. 672,046, filed Mar. 30, 1976, which is a division of Ser. No. 521,901, now U.S. Pat. No. 3,993,491; and which is a continuation-in-part of Ser. No. 422,774, filed Dec. 7, 1973, now abandoned.

BACKGROUND OF THE INVENTION

The present invention relates to electroless plating methods and to solutions used in the electroless plating of non-conductive or dielectric surfaces.

Chemical plating solutions for depositing metals by autocatalytic chemical reduction of metal ions in solution and in contact with a catalytic surface of the article to be plated are well known. Such solutions, which do not use electricity, are referred to in the art as electroless plating solutions. Electroless metal depositions is also distinguished. from displacement metal plating of a type described in Metals Finishing Guide Book, 27th Ed., 1959, pp. 569 Et Seg., and Metal Mirror Procedures. Electroless metal plating has found particular use in plating non-metallic substrates such as ceramics and plastics.

Typically, commercial prior art electroless metal plating of non-metallic substrates is accomplished by the steps of treating the substrates either with a sensitizing solution containing stannous chloride followed by treatment with an activating solution containing palladium chloride or other noble metal, or by first treating the substrate with a seeding solution containing both stannous chloride and palladium chloride together with a stabilizer followed by a treatment with an accelerator solution.

In addition to the attendant costs involved in a process of this nature due to the high cost of palladium, the high catalytic activity of the noble metals is believed to cause contamination of the electroless plating bath, and thus its decompositions.

Imaging processes using non-noble metal systems are described in U.S. Pat. No. 2,504,593, issued Apr. 18, 1950. In the processes described, a non-metallic substrate is coated with a solution containing ions of a non-noble metal, e.g., copper ions and minor amounts of a light sensitive reducing agent and a non-light sensitive reducing agent. The substrate is then exposed in selected areas to ultra-violet light to produce real images.

Similar processes in which non-noble metals are employed have been described more recently in U.S. Pat. Nos. 3,772,056 and 3,772,078. In the processes described therein, the surface of a non-conductive substrate is coated with an aqueous solution of non-noble metal, dried at elevated temperatures, and then exposed to a reducing agent which reduces the non-noble metal to its metallic state. From a commercial standpoint, however, processes of this nature are less desirable in that only limited adhesion results prior to drying and baking. In fact, it is taught in these patents that the surfaces should be dried before treatment with the reducing agent and that the material will wash off of the surface if it is not dried.

The present invention relates to an improved process for the electroless plating of substrates, especially dielectric or non-metallic substrates which is compatible with present-day commercial procedures and equipment, and which does not require the use of palladium or other noble metals, and specifically includes the step of priming of the substrates with solutions which exhibit strong adhesion and which may be rinsed without the necessity of a drying step, and yet retaining an adsorbed layer which constitutes the basis for the catalytic layer.

SUMMARY OF THE INVENTION

The present invention relates to a process for the electroless plating of dielectric or non-conductive substrates, and in particular, relates to a process for rendering said substrates susceptible to plating upon immersion in electroless plating baths. The present invention is further directed to solutions and systems useful in accomplishing said platings.

It is an objective of the present invention to provide a process for preparing non-conductive or dielectric substrates and/or metallic substrates.

It is another object of the present invention to provide a process for the electroless plating of dielectric or non-conductive substrates.

It is yet another object of the present invention to provide solutions for use in the preparation of dielectric or non-conductive substrates for electroless plating.

Other objectives of the present invention, if not specifically set forth herein, will be apparent to one skilled in the art upon the reading of the following Description of the Preferred Embodiment.

DESCRIPTION OF THE PREFERRED EMBODIMENT

The term "priming" as used herein refers to the step of treating a dielectric or non-conductive substrate with stannous and copper ions whether in a single step, or in separate steps, to form a coating containing stannous and cuprous ions on the surface of the substrate.

The term "developing" as used herein refers to the treatment of a substrate subsequent to priming with a reducing agent capable of reducing the cuprous ions present on the surface of the substrate.

In general, the process of the invention comprises the following steps:

(A) Priming a dielectric substrate, which has preferably first been cleaned and etched by conventional procedures, by coating the surface of the substrate with an aqueous solution containing stannous and cuprous ions; and (B) Developing the substrate primed by step (A) by reducing the valence state of the cuprous ions present on the surface, preferably by treating the primed substrate with an aqueous solution containing a reducing agent capable of reducing the valence state of the cuprous ions.

Alternatively, Step (A) may be divided into two steps, i.e., the substrate may be treated with an aqueous solution of stannous ions followed by contacting of the surface with an aqueous solution containing copper ions.

Following priming and developing of the substrate in the aforesaid manner, the substrate may be plated with a desired metal such as copper, nickel, gold or cobalt and combination alloys by immersion of the developed substrate in electroless plating bath of the desired metal.

A system for accomplishing the aforesaid process is comprised of the following solutions:

(A) An aqueous solution containing stannous and cuprous ions; and (B) An aqueous solution of a reducing agent capable of reducing the valence state of the cuprous ions.

While not wishing to be held to any particular theory, it is believed that the stannous and cuprous ions when combined, either on the surface of the substrate or in aqueous solution prior to treatment of the substrate form a stannous-cuprous complex which exhibits strong affinity for the substrate surface. Upon subsequent treatment of the complex with water and an appropriate reducing agent, the complex is first hydrolyzed to form $Cu_2O.nH_2O$ and tin oxide; in turn the reducing agent reduces the ionic copper to the metallic copper on the substrate. Thus, it is desirable to insure that sufficient stannous ions are present to form a complex with cuprous ions.

In the formation of the aforesaid complex, one may begin with cupric ions which are reduced to the cuprous state by the stannous ions, the stannous ions in turn being oxidized to stannic ions. Thus, when employing cupric ions as the source of cuprous ions, sufficient additional stannous ions should be present to accomplish the reduction of the cupric ions to the cuprous state with sufficient stannous ions still being present after such reduction to form the stannous-cuprous complex.

Taking the foregoing factors into consideration, it is desirable that the ratio of stannous to cuprous ions be at least 1:1 in the solution to insure sufficient complex formation. When initially employing cupric ions as the source material, a ratio of at least 1.5:1 stannous to cupric ions is preferably employed in order to affect the desired reduction of the cupric ions to the cuprous state, and have a 1:1 ratio of stannous:cuprous ions after such reduction. Since there is a tendency for cuprous and stannous ions to undergo oxidation to the cupric and stannic states in the presence of air, it is even more desirable to employ additional stannous ions above the aforesaid ratios in order to compensate for such oxidation. For this reason, it is most preferred to use a minimum ratio of stannous: cuprous ions of at least 3:1, and in the case of cupric ions at least 4:1.

It is believed that priming of the surface involved the formation of a stannous:cuprous complex which is adsorbed on the surface and that developing breaks up the complex by first hydrating the cuprous to form $Cu_2O.nH_2O$ which in turn is reduced by the reducing agent to form metallic copper on the surface. It should be understood that this explanation is an hypothesis and the invention is not limited thereby.

In each of the following examples, unless otherwise stated, etched ABS substrates were used along with an electroless copper bath of the following composition:

$CuSO_4.5H_2O$: 15 g/l
EDTA (40%): 68 cc/l
NaOH: 9 g/l
NaCN: 3 ppm
Tergitol-TMN 0.2 wt.% (surfactant by Union Carbide):
HCHO (37%): 20 cc/l In most cases, the plating was carried out at 40° Centigrade. ABS is the name commonly used for a plastic which can be described chemically as acrylonitrilebutadienestyrene. Although ABS substrates were used throughout this work, it should be obvious to those skilled in the art that other plastics, adhesive coatings or other non-metallic surfaces could be readily substituted for the ABS substrate and essentially all non-metallic substrates fall within the spirit of this invention. Similarly, the process is not limited to electroless copper plating and can be employed to plate, for example, Ni, Au and Co using compatible electroless plating baths.

It will be obvious to one skilled in the art that in order for the electroless plating process to initiate onto pretreated catalytic surfaces, certain basic requirements must be met. For example, the catalytic specie(s) present on the surface must interact with the reducing agent(s) present in the electroless plating bath. In this respect it is well known in the art that Ni-P type deposits (derived from hypophosphite containing baths) do not self initiate upon copper surfaces; however, Ni-B type deposits (derived from dimethylamine borane containing baths) do initiate on same copper surface. The difference encountered is due to the choice of the reducing agent present. It is further possible that the initiation of the plating process takes place first via a galvanic replacement type reaction of the metallic ions in solution with the catalytic surface. A typical example is the immersion of a copper substrate into an electroless gold plating formulation.

In choosing a specific electroless formulation, it is essential to know that none of the components present (complexing agents, pH adjuster, stabilizers, etc.) in the electroless formulation is capable of deactivating the catalytic surface either by dissolution or other mechanism. It is thus highly imperative to know and 'tailor-fit' the electroless bath components to the catalytic specie(s) present on the surface.

In view of the above considerations, which are obvious and well known to those skilled in the art, it is not surprosing to find that usind the same catalytic surface, different electroless formulations react differently. This general observation is true in the prior art as well as the new processes described in this invention.

The ABS substrates used in the following examples were prepared in accordance with well known procedures in the art. For example, an etch solution composed of $CrO_3$—400 grams per liter and
$H_2SO_4$ (concentrated 350 grams per liter was employed. The substrates were etched in this solution for about four minutes at a temperature of about 70° Centigrade.

The application of electroless plating to other substrates and the treatment of the surface of these substrates including the step of preparing the substrate by cleaning in etch solution can generally be found with reference to the following publications and those other publications cited therein. The publications referred to are: Plating, June 1973, pp. 611 through 616, and U.S. Pat. Nos. 3,627,558; 3,672,923; 3,607,352; 3,011,920 and 3,425,946. These references are also applicable for typical electrolytes, stabilizers and reducing agents employed in electroless plating processes.

EXAMPLE 1

(a) An etched ABS substrate is immersed for about 1 minute in a primer solution comprising $SnCl_2.2H_2O$—72.4 grams
CuCl—12.5 grams
HCl (conc)—75.0 cc
Distilled—50 cc
$H_2O$ (b) The substrate is then rinsed with water and immersed into a developer solution comprising Dimethylamineborane (DMAB)—5 g/l and NaOH and having a pH of 12.

(c) The primed and developed substrate is then rinsed with water and immersed in an electroless copper bath at 40° C. A continuous conductive electroless copper film was readily deposited which could subsequently act as the base for electroplating.

EXAMPLE 2

The same procedure and solutions as set forth in Example 1 were employed except that the primer solution was diluted one to one with water.

EXAMPLE 3

The same general procedure as set forth in Example 1 was employed except that 3 minute immersions were used in the primer and developer solutions and warm (33° C.) water rinsing was employed in all rinse solutions.

The primer solution used in this example comprised:
$SnCl_2.2H_2O$: 28.4 grams
CuCl: 12.5 grams
HCl (conc): 75.0 cc
DI water: 50.0 cc
The developer solution comprised:
DMAB in water: 0.5 g/l
pH (adjusted with NaOH): 9.5

EXAMPLE 4

The same as example 3 except the primer solution comprised:
$SnCl_2 2H_2O$: 57.0 g
CuCl: 12.5 g
HCl (conc.): 75.0 cc
water 50.0 cc

EXAMPLE 5

The same procedures and solutions as set forth in Example 4 were employed except that after immersion in the primer, rinsing was carried out in a combination of steps consisting of a water rinse followed by an alkaline rinse (pH 12 aqueous NaOH solution) and finally a second water rinse.

EXAMPLE 6

The same procedures and solutions as set forth in Example 3 were employed except that the developer comprised:
$KBH_4$ (aqueous solution): 5.0 g/l
pH (NaOH): 9.0
The developer was kept at room temperature and an immerstion time of 1 minute was employed.

EXAMPLE 7

The same procedure and solution as set forth in Example 3 were employed except that the developer comprised:
$(NH_2)2\ H_2SO_4$ (aqueous solution): 100.0 g/l
pH (NaOH): 11.5
The developer was used at room temperature and an immersion time of 5 minutes in the developer was employed.

EXAMPLE 8

The same procedure and solutions as set forth in Example 3 were employed except that the developer comprised:
HCHO (37%): 200 cc/liter
pH (adjusted with 12.0 NaOH):
and was used at room temperature with a 5 minute immerstion time.

EXAMPLE 9

The same general procedure as set forth in Example 1 was employed utilizing the following solutions:
primer: composition
$SnCl_2$: 0.24 molar
CuCl: 0.06 molar
HCl: 1.08 molar
Distilled water to make up 1 liter Developer—used at 40° C. with a five minute immersion time.
DMAB: 1.5 g/l
pH (NaOH): 11.0 g/l

EXAMPLE 10

The same procedure and solutions as set forth in Example 9 were employed except that the primer comprised
$SnCl_2.2H_2O$: 56.4 grams
CuCl: 6.25 grams
HCl (conc): 38.0 cc
Distilled $H_2O$: 86.0 cc

EXAMPLE 11

The same procedure and solutions as set forth in Example 9 were employed except that the primer comprised:
$SnCl_2$: 0.36 molar
CuCl: 0.06 molar
HCl: 1.26 molar
Distilled water to make up 1 liter

EXAMPLE 12

The same solutions and procedures are employed as set forth in Example 11; however, prior to priming, the substrate is immersed in $2.5\times10^{-3}$ molar stannic chloride solution for about 5 minutes. This stannic chloride solution was prepared by dilution of a 0.5 molar stannic chloride stock solution which had been preaged for about one week from preparation. The substrate, which was glazed ABS of poor wetting quality, was then treated with the priming solution without prior etching since the above treatment acts to improve wetting.

EXAMPLE 13

The same procedure and solutions as set forth in Example 9 are used except that the primer composition was:
$SnCl_2$: 0.48 molar
CuCl: 0.06 molar
HCl: 0.85 molar
Distilled water to make up 1 liter

EXAMPLE 14

An etched ABS substrate is immersed for about 1 minute in a primer solution comprising:
$SnCl_2$: 0.48
CuCl: 0.06 molar
HCl: 1.08 molar
Distilled water to make 1 liter
Following priming of the substrate is rinsed in tap water and then immersed in an alkaline solution (pH 12—NaOH) for two minutes after which room temperature in a developer solution comprising five grams per liter of dimethylamine borane. The developed substrate is finally rinsed before immersion in the electroless plating bath.

EXAMPLE 15

A primer solution was prepared by dilution (4:1) of a concentrate. The working composition comprised:

$CuCl_2$: 0.06 molar
$SnCl_2$: 0.48 molar
HCl: 1.08 molar
Distilled water to make 1 liter The procedure and developer is the same as set forth in Example 9. It should be noted that in this example a cupric salt was used as the source of copper ions. According to an article by T. L. Nunes, Inorganic Chemistry; 9(6), 1325, (1970), there is a reduction of cupric ions to cuprous ions in the presence of stannous ions. It is also interesting to note that the solution absorbance in the range of 800 nm to 400 nm is virtually zero.

Further example of nobel primer solution compositions useful in the practice of the novel plating process are:

EXAMPLE 16

CuCl: 0.06 molar
$SnCl_2$: 0.6 molar
HCl: 0.9 molar

EXAMPLE 17

CuCl: 0.06 molar
$SnCl_2$: 0.96 molar
HCl: 0.96 molar

EXAMPLE 18

CuCl: 0.06 molar
$SnCl_2$: 0.6 molar
HCl: 0.96 molar
Fluorad FC-95 1.5 g/l
Surfactant

EXAMPLE 19

$Cu_2O$: 8.4 g/l
$SnCl_2.2H_2O$: 108 g/l
HCl (conc): 102 ml/l

EXAMPLE 20

CuCl: 6 g
HCl (conc): 80 ml
$SnCl_2.2H_2O$: 135 g
DI water to a volume of 500 ml This solution was divided into two portions. One was heated for about 2 hours at 55° C.; the second was let idle. After cooling, both were diluted 1.1 with DI water and evaluated after five days. No perceptable difference was encountered in the final plating uniformity by the two sensitizer solutions.

It should also be noted that in the preparation of the mixed primer solutions comprising $SnCl_2/Cu^{+1}/HCl$ or $SnCl_2/Cu^{+2}/HCl$, the change of (the copper ion being only intended to identify the source of the copper salt used), there are various manners by which the final compositions could be obtained. Such practices may range from initially mixing all of the components, to procedures of partial dissolution followed by the addition of excess stannous salt and the acid. Any of these procedures may be carried out at room temperature or elevated temperatures and they fall within the spirit of this invention.

Furthermore, from the above examples it should be obvious that the operating temperature of the developer solutions could be varied from room temperature and above. The choice of the operating temperature is generally spelled out by the activity of the developer solution, which is a complex function of pH, nature of the reducing agent, concentration of the reducing agent as well as the reactivity of the primer solution.

It has also been discovered, as previously set forth, that whatever affinity exists between the tin and copper ions, this affinity still exists even if the substrate is treated with these ions in separate containers. Furthermore, the copper salt need not be copper chloride and can be other copper salts which dissociate in solution such as copper sulfate, copper bromide, copper acetate and copper citrate. Copper nitrate however, should not be used due to the oxidation potential of the nitrate ion. In general, precaution should be taken not to use salts having anions which would cause precipitation of either the copper or tin in solution. It is important to note that the primer solution can, if desired, contain noble metal ions in addition to copper and tin without any detrimental results. For example, the primer solution can include one or more of Pt, Pd, Rh, Os, Ir, Au, or Ag ions.

As previously stated with reference to Example 15, the copper salt used in preparation need not be in the form of an cuprous ion provided there is sufficient stannous salt to reduce the cupric ion to cuprous and still have a useful stannous ion concentration remaining.

Further examples illustrating several of the aforementioned variations follows:

EXAMPLE 21-(TWO STEP PRIMING)

(1) An etched ABS substrate is first immersed in a conventional primer solution composed of:
$SnCl_2.2H_2O$: 10 g/l
HCl (conc): 10 g/l
(2) Rinse in water
(3) Immerse for 1 minute in ammoniocal solution containing copper salts, e.g.
CuCl: 5 g/l
$NH_4OH$ (conc): 100 ml/l
(4) Rinse
(5) Immerse 5 minutes in developer solution, e.g.
DMAB: 1.5 g/l
pH (NaOH): 11 at 40° C.
(6) Rinse
(7) Electroless plate

EXAMPLE 22

The same procedure and solutions as set forth in Example 21 are employed except the copper solution in Step 3 is composed of:
$CuSO_4.5H_2O$: 12.5 g/l
$NH_4OH$(conc)*: 100.0 ml/l
*Variations in $NH_4OH$ Concentration from 50 to 300 ml/l does not effect the plating results.

EXAMPLE 23

Same as example 21 however a solution of:

| | |
|---|---|
| $CuSO_4.5H_2O$ | 25.0 g/l |

was used in Step 3.

EXAMPLE 24

Same as Example 21, however a solution of:

| | |
|---|---|
| $CuCl_2.H_2O$ | 17.0 g/l |

was used. The results of this example, however, were not as good as those obtained in Example 23.

In a process similar to Example 21 however, with the substitution for the solution set forth in Step 3, of a solution comprising:

EDTA (40% active solution): 70 cc/l $CuSO_4.5H_2O$: 15 g/l it was found that no plating took place at the conclusion of the cycle. This is believed to be due to the fact that EDTA forms a strong complex with the copper ions thereby preventing the formation of a tin copper association product believed to be formed during priming. In examples 21 through 24 the priming step is carried out in a two step process, the first step utilizing a conventional sensitizer which is primarily composed of stannous salts (e.g., stannous chloride) in acidic media (e.g., hydrochloric acid). This basic formulation can be modified to privide improved stability and wetting on various substrates. Such modifications are reported in the art and it has been found that they may be incorporated along with the new chemistry of this invention. For reference see N. Feldstein, Plating, 60 No. 6 (1973).

Experiments have also shown that increasing the chloride concentrations in the simple priming solution has generally resulted in deterioration of the plating quality. As aforementioned, it is believed that the priming process works via an association of $Sn^{++}$—$Cu^{+}$ ions which tends to be broken when excessive amounts of ions, such as $Cl^{-}$ ions, are present which compete for either the $Sn^{++}$ or $Cu^{+}$ ions with the associated products. This was observed for example by either increasing the HCl content or by the addition of sodium chloride. The same effect would be probably observed with other complexing agents for $Sn^{++}$ or $Cu^{+}$. By contrast, the addition of sulfate ions as sulfuric acid did not result in any deliterious effect and, in fact, some improvement could be noted in plating with both the addition of sulfuric acid and sodium sulfate.

The effect of chloride and sulfate additions can be best illustrated in the following data.

In Table 1, the effect of sodium chloride added to a standard priming solution is illustrated. All solutions and conditions were the same and the results are represented by percent of surface coverage resulting from a brief controlled immersion in an electroless copper bath subsequent to priming and developing.

Table 1

Effect of added sodium chloride

| Added sodium chloride (g/l) | Per cent of area plated |
|---|---|
| None | 50 |
| 158 | 20 |
| 315 | 0 |

In order to demonstrate the effect of sulfate ions, both additions of sulfuric acid and sodium sulfate were carried. The primer solution was composed of:

$SnCl_2$: 0.48 molar

CuCl: 0.06 molar

HCl: 1.08 molar to which concentrated $H_2SO_4$ was added up to about 250 ml/l of solution. In all cases, the plating coverage was found to be independent of added sulfuric acid added in the range outlined. Also, to the same primer solution the addition of up to 319 g/l of sodium sulfate showed no deterioration in plating uniformity and in fact it may be argued that some improvement may have resulted.

Additions of phosphoric acid up to about 200 ml/l to the primer solution showed some deterioration in plating uniformity.

Examples of reducing agents other than DMAB which are suitable in practicing this invention include diethylhydroxylamine and B-N compounds such as N-alkyl-borazones and N-alkylborazoles, borazenes and borazines. The use of such compounds with specific examples, may be found with reference to U.S. Pat. No. 3,140,188. Generally, any reducing agent which reduces copper ions to metallic copper is suitable.

It should be obvious to one skilled in the art that the shelf life of the solutions could be extended by the incorporation of various stabilizers. Such stabilizers generally tend to minimize the oxidation of the stannous ions. This can also be accomplished by bubbling an inert gas through the solutions to minimize the amount of dissolved oxygen. Typical stabilizers, such as ethylene glycol, isopropyl alcohol glycerol, methanol and acetone, and aromatic type stabilizer compounds such as catechol, guinol, pyrogallol and phloroglucinol.

It is also generally preferred to incorporate wetting agents in the solutions. This is especially true when electroless plating is to take place in through-holes or otherwise recessed areas. Wetting agents are known in the art and any wetting agent useful in prior art plating solutions may be useful with the novel solutions herein. Examples of such wetting agents are the fluorinated hydrocarbons e.g. Fluorad FC-98 or FC-95 manufactured by Minnesota Mining and Manufacturing. Other surfactants, either anionic, cationic or nonionic, are also useful provided they are soluble in the acidic priming solutions without causing precipitation of active components. Further examples of stabilizers and wetting agents can be formed in the prior art patents previously cited herein.

The following examples are provided to illustrate the incorporation of various stabilizers to the priming solutions. These stabilizers are disclosed in the various issued patents related to sensitization and activation by stannous and palladium solutions. In all of these examples, a common priming solution composition was used except for the addition of the stabilizer component. The common composition was composed of:

$SnCl_2$: 0.48 molar

CuCl: 0.06 molar

HCl: 1.26 molar

EXAMPLE 25

25 vol% of glycerol

EXAMPLE 26

25 vol% of pluracol PEP 550 Tetrol, an adduct of propylene oxide and pentaerythanotol having an average r.w. of 500 and a hydroxyl number of 450 and 4 secondary alcohol groups sold by Wyandotte Chemicals, Inc.

EXAMPLE 27

7.5 wt% pyrogallol

EXAMPLE 28

7.5% tartaric acid

EXAMPLE 29

4 wt% of sodium p-nitrophenol

EXAMPLE 30

40 wt% methanol

Although as can be seen, the concentration of the constitution of the priming solution may vary appreciably over a large concentration range, in all cases, it was found necessary to have a larger molar concentration of the stannous ions relative to the copper ions. Typical concentration ranges for the copper and tin in the single primer solutions are as follows:

| Ion | Concentration Range (Molar) |
|---|---|
| Cu | 0.03–1.0 |
| Sn (II) | 0.12–15.0 |

In all cases sufficient acid is added to insure complete dissolution. The preferred ratio of concentration of stannous ion to copper ion in the single primer is generally greater than about 4:1 where the copper is added as cupric ion and greater than about 3:1 where the copper is added as cuprous ion.

In the preceding examples it will be noted that the pH of the aqueous developer solutions is adjusted to an alkaline value. Such adjustment is preferable in most instances in order to prevent decomposition or reduced activity of the reducing agent employed and thus insure optimum effectiveness of the system at minimum cost. Such adjustment is ultimately accomplished by the introduction of sodium hydroxide which is preferred from the standpoint of cost considerations. It will be obvious, however, that other available hydroxides may be employed. For example, substitution of potassium hydroxide for sodium hydroxide provides identical results. Similarly, tetramethylhydroxylamine, lithium hydroxide or cesium hydroxide can also be employed. It was also observed that the substitution of other basic materials, e.g., ammonia, ethylenediamine and triethanolamine did not provide as good a result as with the use of sodium hydroxide. More specifically, the following were tried with DMAB (2.0 g/l) with the results indicated.

| | | Per cent plated area* |
|---|---|---|
| $NH_4OH$ to pH | 12 | none |
| Ethylenediamine to pH | 12 | 5 |
| Triethanolamine to pH | 11 | none |
| KOH | 12 | 100 |

In the foregoing examples it is believed that reduction in plating may result from the amine acting to etch the copper surface.

It will be apparent, after a reading of the present description, however, that it will not be necessary in all cases to adjust the pH of the developer solution to the alkaline state and/or rinse may be mildly acidic, and that such adjustment will depend upon the nature of the particular reducing agent employed. Examples of development using reducing agents in which adjustment of the developer solution to the alkaline state is not required are illustrated in the following examples:

EXAMPLE 31

Etched ABS substrates were immersed for ten minutes in a prewetting solution composed of 50 ml/l of aged 0.5 M $SnCl_4$ solution and 100 g/l NaCl. The substrates were then rinsed and placed in a primer solution, also for ten minutes, of the following composition:

CuCl—0.06 M
$SnCl_2$—0.6 M
HCl—1.08 M

The substrates were again rinsed and placed in a developer solution of 5 g/l DMAB at 45° C. for five minutes. The pH of the developer solution was adjusted up and down by the addition of either dilute NaOH or HCl. pH values ranged from 4.5 to 10.5. After a final rinse, the substrates were immersed in a copper electroless solution, also at 45° C. Uniform plating with good coverage was obtained on all the substrates. The performance of the system was independent of the pH of the developer solution within the range given above.

Alternatively, etched ABS substrates were immersed in the above pre-wetting solution for three minutes, rinsed, placed in the above sensitizer ($CuCl/SnCl_2/HCl$) for three minutes, rinsed and immersed for three minutes in a solution of either NaOH or HCl to give a range of pH values between 4.5 and 7.5. The substrates were then placed in a developer of $KBH_4$(1 g/l) for three minutes before final rinse and immersion in a copper electroless solution at 40° C. Uniform plating with complete coverage was obtained on all substrates.

While pH is thus not a critical factor, it will be apparent that extremely high or low pH values will not normally be employed due to the tendency of the primed surface to become etched under such conditions.

The following examples illustrate still another aspect of the present invention wherein a primary solution comprises a combination of copper and precious metal ions.

Although the examples shown utilize palladium ions, it should be obvious that substitution of other noble metal salts in the combination taught here are within the spirit of this invention.

In preparing the combined primer solution used in the following examples, the combined solution in a concentrate form was heated for several hours, allowed to cool and then diluted to final composition. Alternatively, of course, is prolong aging at room temperature.

EXAMPLE 32

A typical primer solution of this type comprises in the following molar proportions:

CuCl—0.06 M
$PdCl_2$—0.06 M
$SnCl_2$—0.48 M
HCl—0.96 M

Subsequent to priming the substrate is treated with a developer solution followed by electroless plating. The developer solution was an alkaline solution containing dimethylamine borane. Effective plating with an electroless copper bath was accomplished at room temperature.

EXAMPLE 33

Same as Example 32 except plating was carried out with a room temperature electroless bath of the following composition:

$NiSO_4.5H_2O$: 25 g/l
$Na_4P_2O_7.10H_2O$: 50 g/l
DMAB: 2.0 g/l
$NH_4OH$ (conc): 20 cc/l

EXAMPLE 34

Same as Example 3 except an electroless cobalt bath was used with DMAB of about 5 g/l at 50° C.

In the following examples, other stannous salts were used rather than stannous chloride. Although in both of the examples incomplete dissolution took place the substrates were completely plated at the end of the cycle.

EXAMPLE 35

Primer solution used at room temperature comprised:
'CuCl: 0.06 M
$SnF_2$: 0.06 M
HCl: 1.08 M
The developer was composed of:
$KHB_4$: 5.0 g/l
NaOH: at pH of 9.5
Developer was used at room temperature for 1 minute. The substrate was finally immersed in an electroless copper bath.

EXAMPLE 36

Primer solution comprising:
$SnBr_2$: 0.6 M
CuCl: 0.06 M
HCl: 1.08 M
The remaining solutions and conditions are the same as the preceding example. Note that the molar quantity of $SnBr_2$ is based upon the number of grams added rather than the quantity dissolved. Stannous sulfate was also used successfully as a substitute for stannous bromide.

As previously noted, electroless plating of nickel or cobalt instead of copper can also be effected using the present invention as illustrated by the following example:

EXAMPLE 37

In the current example etched ABS substrate was treated in a primer solution composed of:
CuCl—0.06 M
$SnCl_2$—0.48 M
HCl—0.96 M
followed by immersion in a developer ($KBH_4$—3 g/l at pH 10 at 25° C.) 2–5 minutes. Following the catalytic preparation, electroless nickel and cobalt plating respectively was undertaken using the following electroless baths:

| Electroless Nickel Composition | |
|---|---|
| $Ni^{+2}$(from a sulfamate conc) | 8 g/l |
| DMAB | 8 g/l |
| pH adjusted to 5.5 with 0.1M NaOH | |
| Temperature | 49° C. |
| **Electroless Cobalt Composition** | |
| $COSO_4 . 7H_2O$ | 25 g/l |
| Disodium Succinate . $6H_2O$ | 25 g/l |
| DMAB | 4 g/l |
| pH adjusted to 6.7 by addition of 0.1M HCl | |
| Temperature | 65°–70° C. |

The present invention also contemplates a process for the electroless plating of metallic patterns on dielectric or non-conductive substrates by the introduction of an additional step in the aforesaid procedure.

Specifically, metallic patterns may be formed on dielectric substrates in accordance with the present invention by the following process:

(A) Contacting the dielectric substrate, which has preferably first been cleaned and etched by conventional procedures, with an aqueous solution containing stannous ions, e.g., an aqueous solution of stannous chloride.

(B) Oxidizing selected areas of the stannous ions on the substrate, which preferably has first been dired;

(C) Contacting the surface of the substrate with aqueous solutions containing copper ions to form stannous and cuprous ions on the non-oxidized surfaces of the substrate; and (D) Reducing the valence state of the cuprous ions.

Substrates treated by the aforesaid procedure by subsequent immersion in an electroless plating bath are selectively plated in accordance with the configuration of the photomask.

Preferably, step (B) of the aforesaid process is accomplished by selective radiation of the substrate surface through a photomask using a suitable ultra-violet light source. A step of this type is disclosed per se in U.S. Pat. No. 3,562,005. The following example is illustrative of this process:

EXAMPLE 38

(A) Cleaned substrates are immersed into a sensitizer solution having the following composition for 1–2 minutes duration and thereafter rinsed and dried:
$SnCl_2.2H_2O$: 10 g/l
HCl (conc): 10 cc/l (B) The treated substrates were then irradiated with ultra-violet light for 0.5 to 5 minutes with an Oriel Optics Model c-73-16 Mercury Pen Light held 2 inches above the sensitized substrate. This irradiation is carried out through a mask which permits selective transmission of the ultra-violet light and thereby providing a selective photo chemical reaction with the absorbed sensitizer components or absorbed product derived from the sensitized solution. (Other U-V light sources are also suitable).

(C) The irradiated substrates were then immersed into a copper containing solution, e.g.,
$CuSO_4.5H_2O$—20 g/l
$NH_4OH$ (conc)—175 ml/l (D) Immersion of the primed substrate into a developer solution for 3–5 minutes at 40° C. followed. A typical solution freshly prepared comprises:
$KBH_4$: 2 g/l
pH (kOH): 11

(E) Immersion into electroless copper bath to provide the metallic pattern desired. Plating periods are generally specified by the desired thickness. A typical composition is:
EDTA (40%): 68 cc/l
$CuSO_4.5H_2O$: 15 g/l
NaOH: 9 g/l
$H_2CO$ (37%): 20 cc/l
NaCN: 3 ppm (F) Electroplating build-up (optional)

EXAMPLE 39

In this example various substrates were employed to demonstrate the versitility of the current inventions. The substrates used were: Mylar, Kapton, Teflon, fiberglass board, glazed ABS, Cycolac plater (ABS type), and coated phenolic. In all cases after the plating cycle, complete metallic coverage was noted. The cycle used was as follows:

Pre Primer Immersion 1 minute in 50 cc/l of aged stock 0.4 M $SnCl_4$ solution, saturated with sodium chloride.

Primar

Solution was composed of:
CuCl: 0.06 M
$SnCl_2$: 0.48 M
HCl: 0.96 M
Surfactant FC-95: 1.5 g/l
1-minute immersion was used Developer 1-minute at room temperature
Solution was composed of
$KBH_4$ 5 g/l Electroless Copper Immersion at 40° C. for 2-minutes was used, bath composition same as above.

It will be apparent to one skilled in the art that many modifications and variations of the invention previously described may be made without departing from the spirit and scope thereof. For example, it is possible to combine the development step with the electroless plating step by using an electroless plating bath containing an appropriate reducing agent. This alternative is believed to be less desirable, however, due to possible contamination of the plating bath.

I claim:

1. A process for producing a metallic pattern on a substrate comprising the steps of
   (a) contacting said substrate with an aqueous solution of stannous ions;
   (b) drying said substrate;
   (c) oxidizing selected portions of said substrate;
   (d) contacting said substrate with an aqueous solution of copper ions; and
   (e) contacting said substrate with a reducing agent capable of reducing the valence state of said copper ions.

2. The process of claim 1, wherein said oxidizing is effected with ultra-violet light.

3. A process for the preparation of a non-conductor prior to electroless metal deposition comprising the steps of
   (a) contacting said substrate with a composition comprising stannous ions, and
   (b) contacting the treated substrate with a composition comprising copper ions.

4. The process according to claim 3 further containing the step of electroless metal deposition.

5. The process according to claim 3 wherein said copper ions are derived from a copper(I) compound.

6. The process according to claim 3 wherein said copper ions are derived from a copper(II) compound.

7. The process according to claim 3 wherein said composition comprising stannous ions further contains aged tin(IV).

8. The process according to claim 3 further containing the step of development which is prior to electroless metal deposition and wherein said development comprises a reducing composition capable of reducing the copper ions adsorbed onto the substrate to a lower or elemental oxidative state.

* * * * *